US007010811B1

(12) United States Patent
Park

(10) Patent No.: US 7,010,811 B1
(45) **Date of Patent: *Mar. 14, 2006**

(54) LIGHTWEIGHT SOFT BODY-ARMOR PRODUCT

(75) Inventor: Andrew D. Park, Midlothian, VA (US)

(73) Assignee: PTI Materials LLC, Tempe, AZ (US)

( * ) Notice: Subject to any disclaimer, the term of this patent is extended or adjusted under 35 U.S.C. 154(b) by 47 days.

This patent is subject to a terminal disclaimer.

(21) Appl. No.: 10/730,304

(22) Filed: Dec. 8, 2003

Related U.S. Application Data

(63) Continuation-in-part of application No. 09/943,678, filed on Aug. 30, 2001, now abandoned.

(51) Int. Cl.
*F41H 1/02* (2006.01)

(52) U.S. Cl. ..... 2/2.5; 89/36.02

(58) Field of Classification Search ..... 2/2.5, 2/102, 94, 96, 97, 247, 462, 464, 467; 89/36.01, 89/36.02, 36.05; 428/911
See application file for complete search history.

(56) References Cited

U.S. PATENT DOCUMENTS

| | | | | |
|---|---|---|---|---|
| 4,842,923 A * | 6/1989 | Hartman | | 428/219 |
| 4,916,000 A | 4/1990 | Li et al. | | |
| 5,926,842 A | 7/1999 | Price et al. | | |
| 6,147,018 A | 11/2000 | Chiou | | |
| 6,162,746 A | 12/2000 | Chiou | | |
| 6,240,557 B1 * | 6/2001 | Bachner, Jr. | | 2/2.5 |
| 6,266,819 B1 * | 7/2001 | Bachner, Jr. | | 2/2.5 |
| 6,276,255 B1 * | 8/2001 | Field et al. | | 89/36.05 |
| 6,449,769 B1 | 9/2002 | Bachner, Jr. | | |
| 6,605,334 B1 * | 8/2003 | Bettencourt | | 428/100 |
| 6,651,543 B1 * | 11/2003 | Park | | 89/36.02 |

OTHER PUBLICATIONS

PM-Soldier Equipment; Personnel Armor System for Ground Troops (PASGT) Vest; pp. 1-2; Published prior to Aug. 28, 2001.
DuPont; "KEVLAR ® Brand Fiber"; Entire Brochure; Published Prior to Aug. 28, 2001.
DuPont; "KEVLAR KM2 ®: Cooler—Drier—More Flexible"; Entire Brochure; Published prior to Aug. 28, 2001.
DHB Capital Group Inc.; "Point Blank Body Armor"; Entire Catalog; Published 1996.
Specialty Plastic Products Inc.; "Combat Helmets—Ballastic Kevlar ® Armor for Increased Protection"; Entire Brochure; Published prior to Aug. 28, 2001.
"Bulletproof Bravado—Interceptor Body Armor System Provides Ultimate Protection for Front-line Troops"; 5 Pages; Published prior to Aug. 28, 2001.

(Continued)

*Primary Examiner*—Tejash Patel
(74) *Attorney, Agent, or Firm*—Schwartz Law Firm P.C.

(57) ABSTRACT

A ballistic panel is provided for being incorporated into a lightweight soft body-armor product adapted for covering an area of the body. The ballistic panel includes an assembly of woven fabric plies with warp and fill yarns formed of bundled Poly (p-phenylene-2, 6-benzobisoxazole) fibers. The plies have a collective areal density of no greater than 1.0 pounds per square foot, and a V50 ballistic limit of no less than 1925 feet per second using a .22 caliber, 17 grain FSP at 0 degrees obliquity.

20 Claims, 4 Drawing Sheets

OTHER PUBLICATIONS

PM-Soldier Equipment; "Combat Vehicle Crewmen's (CVC) Fragmentation Protective Undergarment"; pp. 1-2; Published prior to Aug. 28, 2001.

Specialty Plastic Products Inc.; "Combat Vehicle Crewman Vest"; Entire Brochure; Published prior to Aug. 28, 2001.

PM-Soldier Equipment; "Interceptor Body Armor"; pp. 1-2; Published prior to Aug. 28, 2001.

Specialty Plastic Products Inc.; "PASGT Ballistic Vest"; Entire Brochure; Published prior to Aug. 28, 2001.

* cited by examiner

LIGHTWEIGHT SOFT BODY-ARMOR PRODUCT

TECHNICAL FIELD AND BACKGROUND OF THE INVENTION

This application relates to a lightweight soft body-armor product. The invention is particularly applicable for military use in anti-fragmentation and small-arms protection garments. More specifically, the invention is a lightweight flak vest weighing less than 8.8 pounds and exhibiting extraordinary fragmentation resistance.

In traditional warfare, the highest percentage of casualties are caused by fragments from mines, grenades, mortars, shell fragments, and other related munitions. For years, the U.S. military has used soft body-armor products to protect against fragments. These products have generally performed well, are relatively lightweight as compared to hard armor, and afford a wide-range of mobility. The overall weight of the product, and more importantly, its ballistic resistance performance are critical.

In the ballistics industry, performance is generally determined based on V50 ballistic test limits for impacts on an 18"×18" test cloth. The test cloth is formed of multiple overlying plies of ballistic fabric. The V50 ballistic test limit is the average of 10 fair impact velocities consisting of the five lowest complete penetration velocities and five highest partial penetration velocities provided that the spread for the 10 velocities is not greater than an allowable range of 150 feet per second (fps). If the 10-round average cannot be attained within the allowable range, the ballistic cloth is retested. The V50 ballistic limit is determined for a given-size steel fragment by averaging the V50 test results for three test cloths.

Current soft body-armor garments incorporating KEVLAR® fabric represent a substantial advancement over traditional nylon garments. KEVLAR is a high-tech aramid fiber developed by E.I. duPont deNemours and Co., Inc. Pound for pound, KEVLAR® is five times stronger than steel, has a very high stretch resistance, is inherently flame resistant, and will not melt. When struck by artillery or shrapnel, KEVLAR® fibers absorb the impact energy and disperse it to other fibers in the fabric weave. Its non-melting, self-extinguishing properties keep heat and flames outside of the ballistic garment, and away from the body.

The prior art Personal Armor System for Ground Troops (PASGT) Vest developed for the Army uses KEVLAR® fibers. This vest weighs approximately 12.0 pounds (medium size), and has a V50 ballistic test limit of 1650 fps using a .22 caliber, 17 grain Fragmentation Simulated Projectile (FSP) at 0 degrees obliquity. To meet a demand for increased ballistic performance, a fragmentation vest upgrade including hard-armor plates was specifically designed to integrate with the PASGT vest. While the vest upgrade improved performance against artillery fire, the overall weight of the combined PASGT vest jumped substantially making it generally undesirable for use in certain military applications.

In recent years, a further military garment incorporating the requirements of the Army and Marines was developed to replace the PASGT/upgrade combination. The INTERCEPTOR is the model name for modular, multiple-threat body armor. This garment includes an outer tactical vest, and front and back small arms protective insert plates. Although the overall weight of the INTERCEPTOR body armor is substantially less than the PASGT/upgrade combination, the total weight remains relatively high.

The present invention addresses a long-felt need in today's military for an improved soft body-armor garment with increased ballistic resistance performance and reduced overall weight. The invention provides both fragmentation and small-arms protection. The invention has particular application for use by Navy personnel aboard Navy ships to protect the wearer against fragments and artillery fire while performing duties above deck.

SUMMARY OF THE INVENTION

Therefore, it is an object of the invention to provide soft body-armor product which provides increased ballistic resistance performance and reduced overall weight.

It is another object of the invention to provide a soft body-armor product which is designed to reduce casualties caused by fragments and artillery fire.

It is another object of the invention to provide a soft body-armor product which weighs substantially less than the PASGT vest designed for the Army.

It is another object of the invention to provide a soft body-armor product which has an overall weight of less than 8.8 pounds.

It is another object of the invention to provide a soft body-armor product which has an overall weight of between 6 and 6.5 pounds.

It is another object of the invention to provide a soft body-armor product which provides substantially increased ballistic resistance performance than the vest used in the INTERCEPTOR body armor system.

It is another object of the invention to provide a soft body-armor product which has a minimum V50 ballistic test limit of 1925 fps.

It is another object of the invention to provide a soft body-armor product which has increased flexibility.

It is another object of the invention to provide a soft body-armor product which is ergonomically engineered for increased comfort, mobility and versatility.

It is another object of the invention to provide a soft body-armor product which protects against threat levels as high as IIIA, as defined by the U.S. National Institute of Justice Standard.

It is another object of the invention to provide a soft body-armor product which incorporates high performance, high modulus, Poly (p-phenylene-2, 6-benzobisoxazole) fibers, known in the industry as PBO fibers.

It is another object of the invention to provide a soft body-armor product which incorporates high performance PBO fibers manufactured by Toyobo Co., Ltd. and sold under the trademark ZYLON®.

It is another object of the invention to provide a soft body-armor product which incorporates PBO fibers which are post treated to reduce moisture regain.

It is another object of the invention to provide a soft body-armor product which promotes enhanced diffusion of moisture through PBO fiber bundles incorporated in the fabric plies.

It is another object of the invention to provide a soft body-armor product which incorporates PBO fibers that are step drawn to reduce the continuous length of machinery required for post treatment.

It is another object of the invention to provide a soft body-armor product which incorporates fibers having high flame resistance and thermal stability, as compared to other organic fibers.

It is another object of the invention to provide a soft body-armor product which incorporates fibers having superior tensile strength and modulus, as compared to p-aramid fibers.

It is another object of the invention to provide a soft body-armor product which incorporates fibers having improved creep performance, chemical resistance, cut/abrasion resistance, and high-temperature abrasion resistance, as compared to p-aramid fibers.

These and other objects of the present invention are achieved in the preferred embodiments disclosed below by providing a ballistic panel for being incorporated into a lightweight soft body-armor product adapted for covering an area of the body. The ballistic panel includes an assembly of woven fabric plies with warp and fill yarns formed of bundled PBO fibers. The fibers are stretched during a post-treatment process at a draw ratio higher than 1:1 to promote dissipation of moisture. The plies have a collective areal density of no greater than 1.0 pounds per square foot, and a V50 ballistic limit of no less than 1925 feet per second using a .22 caliber, 17 grain FSP at 0 degrees obliquity.

According to another preferred embodiment of the invention, the warp yarns weigh approximately 500 denier. Denier is defined as the weight in grams of 9000 meters of yarn.

According to another preferred embodiment of the invention, the fill yarns weigh approximately 500 denier.

According to another preferred embodiment of the invention, each of the woven fabric plies includes between 25 and 45 ends of warp yarn per inch.

According to another preferred embodiment of the invention, each of the woven fabric plies includes between 25 and 45 ends of fill yarn per inch.

According to another preferred embodiment of the invention, the woven fabric plies are formed using a plain weave.

According to another preferred embodiment of the invention, the assembly includes between 25 and 40 overlapping fabric plies.

According to another preferred embodiment of the invention, the tensile modulus of the warp and fill yarns is greater than 1500 grams/denier.

According to another preferred embodiment of the invention, the tensile strength of the warp and fill yarns is greater than 40 grams/denier.

In another embodiment, the invention is a ballistic panel for being incorporated into a lightweight soft body-armor product adapted for covering an area of the body. The ballistic panel includes an assembly of overlapping plain-weave fabric plies with warp and fill yarns formed of bundled PBO fibers. The warp and fill yarns each weigh approximately 500 denier. The plies have a collective areal density of no greater than 1.0 pounds per square foot, and a V50 ballistic limit of no less than 1925 feet per second using a .22 caliber, 17 grain FSP at 0 degrees obliquity.

In yet another embodiment, the invention is a lightweight soft body-armor product adapted for covering an area of the body. The body-armor product includes at least one ballistic panel formed of an assembly of woven fabric plies with warp and fill yarns formed of bundled PBO fibers. The plies have a collective areal density of no greater than 1.0 pounds per square foot, and a V50 ballistic limit of no less than 1925 feet per second using a .22 caliber, 17 grain FSP at 0 degrees obliquity.

According to another preferred embodiment of the invention, the body-armor product is a ballistic flak vest.

Preferably, the overall weight of ballistic flak vest is less than 6.5 pounds.

In yet another preferred embodiment, the invention is a method of forming a lightweight soft body-armor product adapted for covering an area of the body. The method includes the steps of forming a panel of overlapping woven fabric plies with warp and fill yarns formed of bundled PBO fibers. The overlapping plies have a collective areal density of no greater than 1.0 pounds per square foot, and a V50 ballistic limit of no less than 1925 feet per second using a .22 caliber, 17 grain FSP at 0 degrees obliquity. The panel is incorporated into an outer shell material of the body-armor product.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
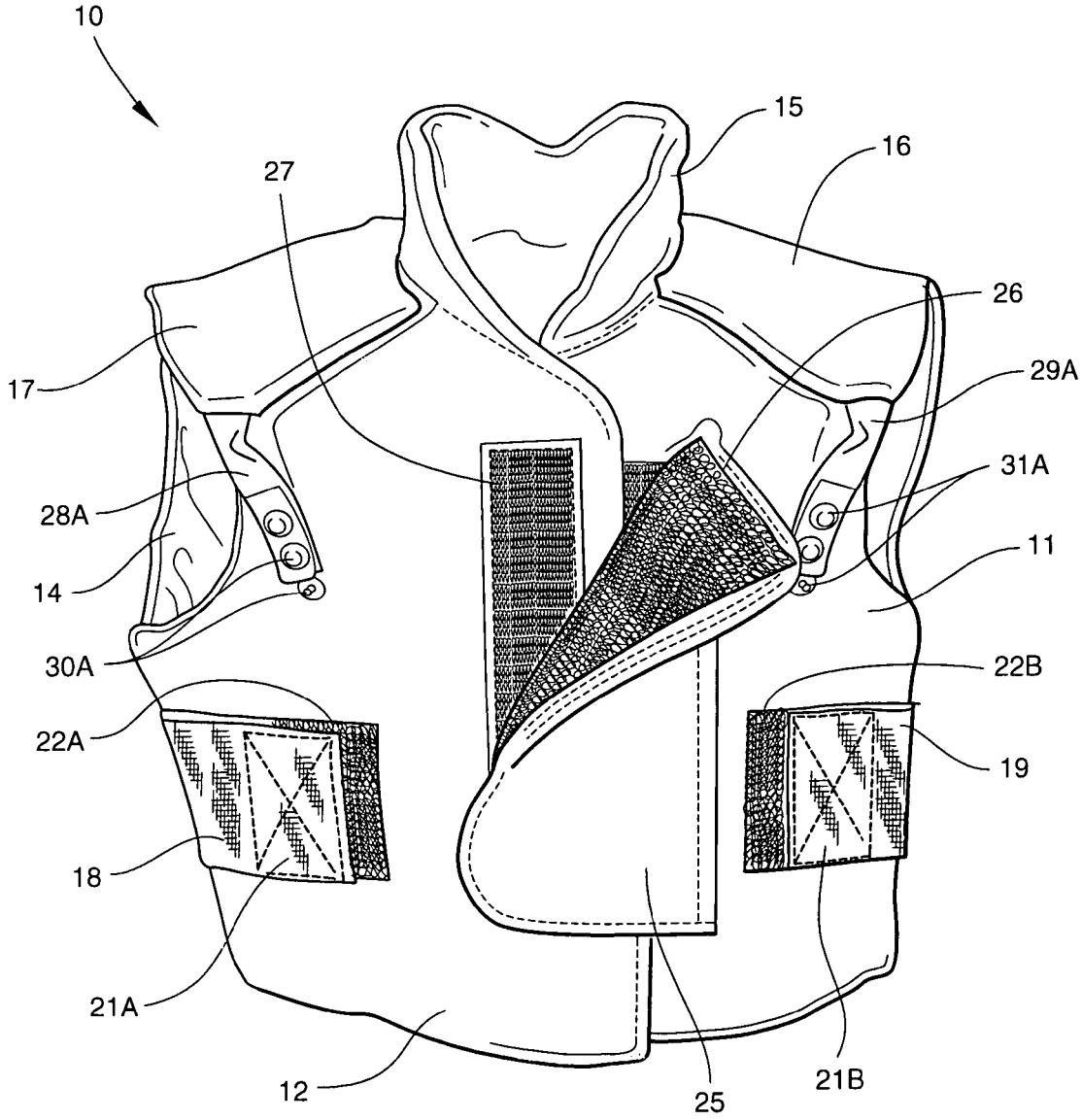
FIG. 1 is a front view of a ballistic flak vest according to one preferred embodiment of the present invention.
Figure 2:
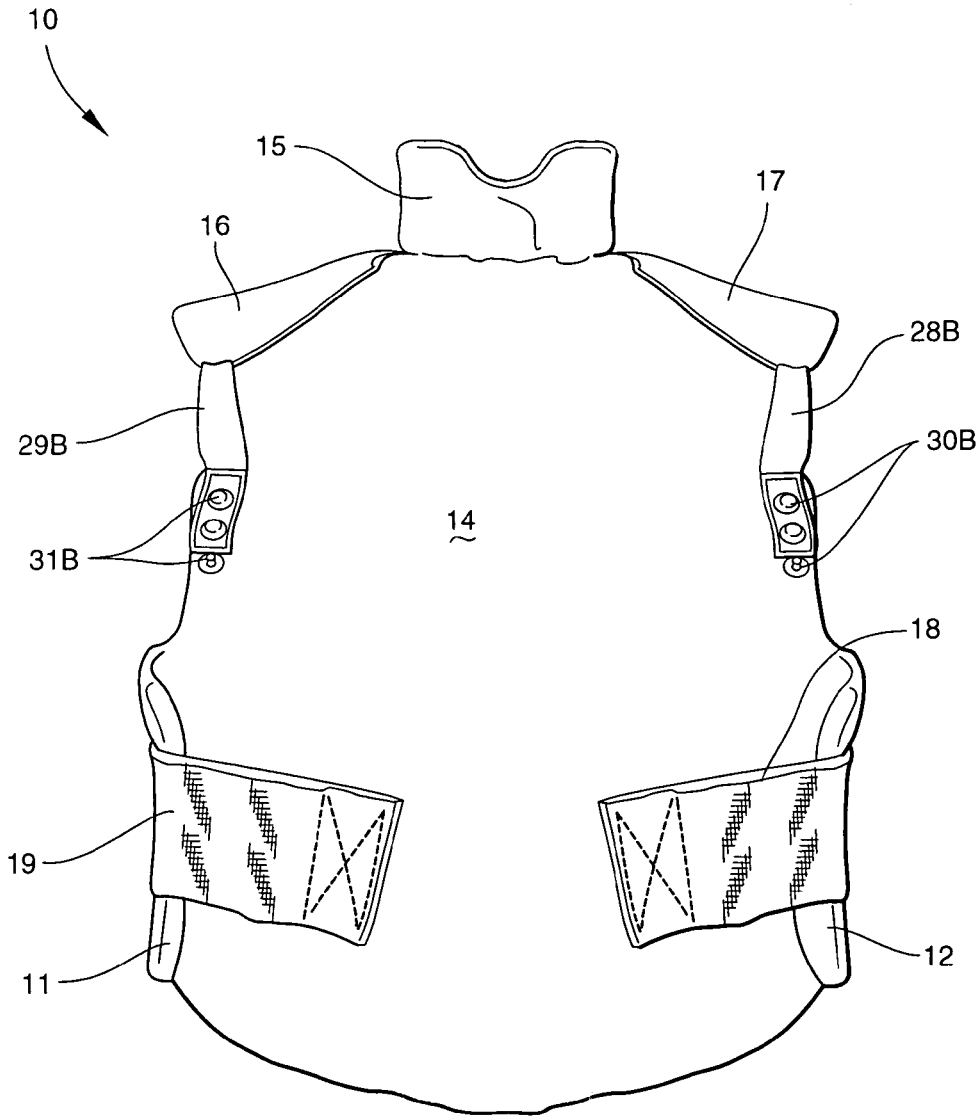
FIG. 2 is a back view of the ballistic flak vest.

Referring now specifically to the drawings, a soft body-armor product according to the present invention is illustrated in FIG. 1 and shown generally at reference numeral 10. Although a flak vest 10 is shown and described below, the principle of the invention is broadly applicable to any soft body-armor product. The flak vest 10 is especially adapted for use by Navy personnel aboard Navy ships to protect the wearer against fragments and artillery fire while performing duties above deck. The vest 10 is ergonomically-engineered for increased comfort, mobility and versatility.

Figure 3:
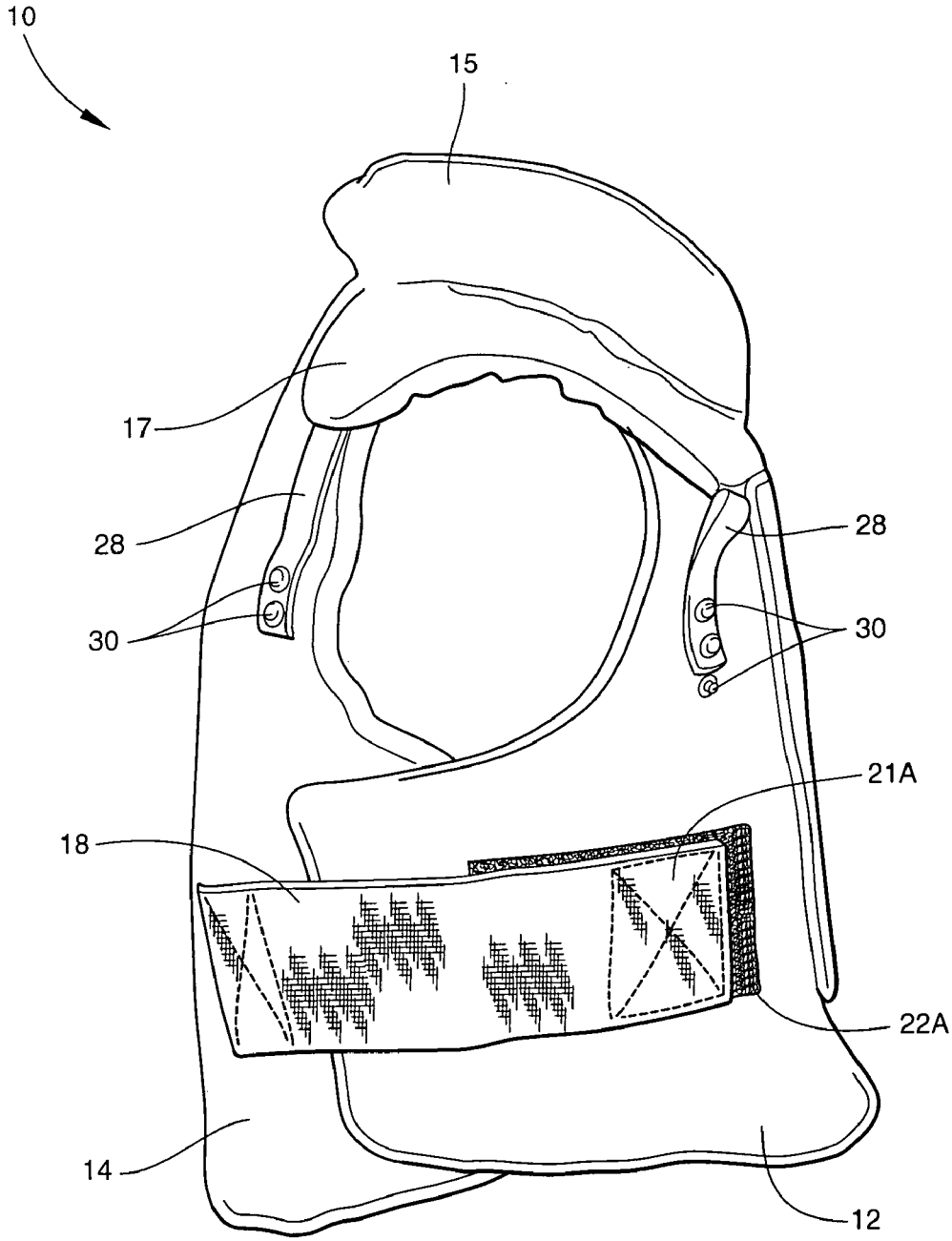
FIG. 3 is a side view of the ballistic flak vest.
Figure 4:
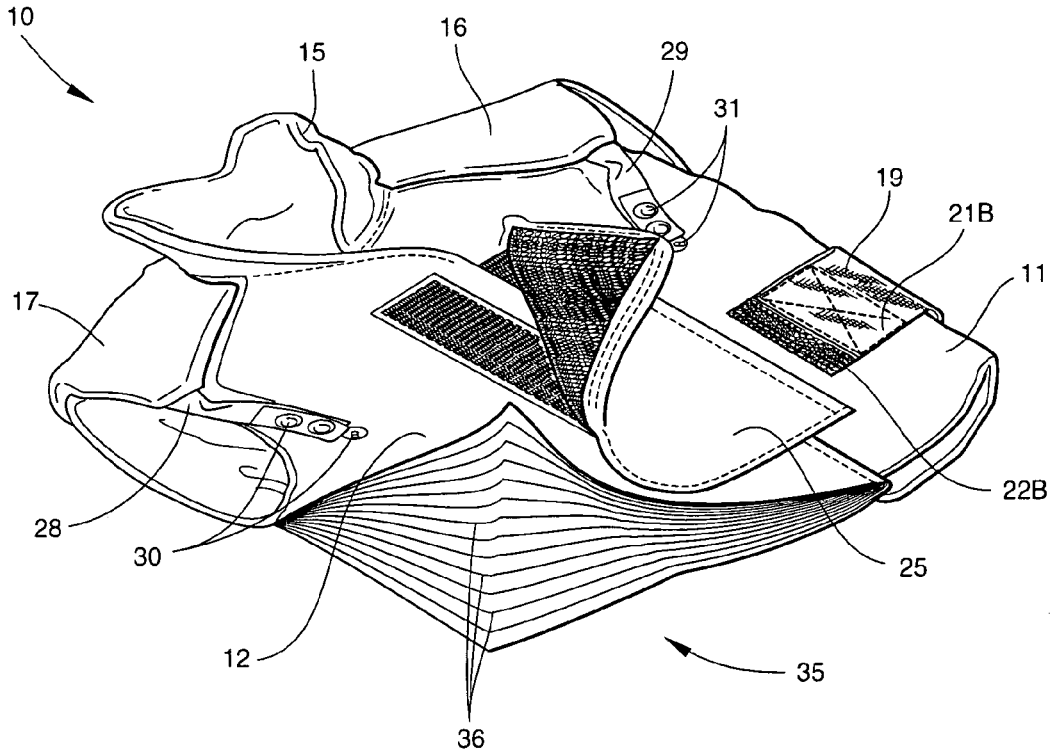
FIG. 4 is a perspective view of the ballistic flak vest with a front section cut away to illustrate the assembly of overlying plies in the ballistic panel.

Referring to FIGS. 1, 3, and 4, the vest 10 includes two front sections 11 and 12, a back 14, a stand-up collar 15, and removable shoulder shields 16 and 17. The two front sections 11 and 12 are sewn to the back 14 along respective top edges extending from the neckline to the armholes. The sides of the front sections 11, 12 are secured to the back 14, as shown in FIG. 3, using elastic straps 18 and 19. The elastic straps 18 and 19 are sewn to the back 14 at respective proximal ends, and have loop panels 21A, 21B located at respective free ends which releasably engage panels 22A, 22B of complementary hooks formed on the front sections 11 and 12. The elastic straps 18 and 19 cooperate to provide a side adjustment system for closely fitting the vest 10 to the body of the wearer. The front sections 11, 12 of the vest 10 are releasably joined together by a front closure system including a closure flap 25 sewn to the front section 11 and having a vertical loop strip 26 adapted for mating with a complementary hook strip 27 formed on the front section 12. The shoulder shields 16 and 17 are attached using nylon straps 28A, 28B and 29A, 29B, respectively, and complementary fastener snaps 30A, 30B and 31A, 31B.

For a medium size vest, the front width dimension measured from the side seam at the base of the armhole to a front edge of the front section is 15.5 inches. The front length of the vest measured from the base of the collar (the neckline) to the bottom edge of the front section is 18 inches. The back width of the vest measured from edge to edge at the base of each armhole is 21 inches. The back length of the vest measured along the center back from the neck edge to the bottom of the vest is 23.25 inches. The collar extends 3.0 inches above the back of the neck.

The front sections 11 and 12, back 14, collar 15, and shoulder shields 16 and 17 of the vest 10 include respective ballistic panels 35 (see FIG. 4) enclosed in an outer shell material. The outer shell material is preferably a flame resistant/water-repellent treated, meta-aramid, plain weave cloth. The cloth weighs 8.5 to 9.5 ounces per square yard with a minimum of 37 (warp)×31 (fill) yarns per inch. The yarn is air textured, 850 to 950 denier. In flammability testing pursuant to FED-STD-191A, Test Method 5903.1, the shell material has a maximum after flame of 2 seconds and a minimum char length of 6 inches. Per ASTM D5034-90, the shell material has a grab strength of no less than 450 pounds (warp) and 320 pounds (fill). Per FED-STD-191A, Test Methods 5500.1 and 5556, the shell material has a dynamic absorption of no more than 15% (initial and after one laundering). According to one preferred embodiment, the outer shell material is constructed of yarns manufactured by E.I. duPont deNemours and Co., Inc. and sold commercially under the trademark NOMEX®. The yarns are woven by Milliken & Company.

Referring to FIG. 4, each ballistic panel 35 is constructed of an assembly of overlying woven fabric plies 36 with warp and fill yarns formed of bundled, post treated, HM PBO fibers. Prior to incorporation in the fabric plies 36, the PBO fibers are processed under heat and tension, and stretched to dry the fibers. Preferably, the PBO fibers are stretched in increments (or step drawn) in order to reduce the overall length of machinery required for post treatment. The resulting step drawn fibers exhibit substantially low moisture regain in the range of 0.1% to 1.0% at 70 degrees F. and 65% relative humidity. Preferably, the draw ratio of the PBO fiber is in the range of 1:1 to 1:10—the "draw ratio" being defined as the ratio of attenuated fiber cross sectional area to the initial cross sectional area.

The PBO fabric plies 36 are sewn together using conventional stitching to form a multilayer composite having an areal density of no greater than 1.0 pounds per square foot. The resulting panel 35 is lightweight, and exhibits extraordinary ballistic resistance performance. The panels 35 are incorporated into the outer shell fabric in all parts of the vest—the front sections 11 and 12, back 14, collar 15, and shoulder shields 16 and 17, respectively. In overlying side areas of the vest 10, a number of narrow plies are preferably laid in between adjacent wider plies in the panels such that the overlying side areas collectively meet the minimum ply requirement necessary to achieve the desired ballistic performance. A one-half inch seam allowance is afforded at the seams between the front sections 11 and 12, back 14 and collar 15. The overall weight of a medium size vest is less than 8.8 pounds.

The following example illustrates one specific preferred construction of the present soft body-armor product. Additional plies may be used to achieve greater ballistic resistance performance, or fewer plies to achieve a lighter weight product.

EXAMPLE

A ballistic panel including 34 overlying plies of 500 denier, plain weave ZYLON® HM material with a 35×35 weave construction and an areal density of 0.96 lbs./sq. ft. achieved a V50 ballistic test performance at a minimum 1995 feet per second using a .22 caliber, 17 grain FSP at 0 degrees obliquity. The physical characteristics of ZYLON® HM are as follows:

| | |
|---|---|
| Tensile Strength | 42 grams/denier |
| Modulus | 2000 grams/denier |
| Elongation | 2.5% (at break) |
| Density | 1.56 grams/cc |
| Std. Moisture Regain | nominal 0.6% at 70 degrees F. and 65% relative humidity |

The overall weight of a medium size vest incorporating these panels in the front sections, back, collar, and shoulder shields is approximately 6.4 pounds. The V50 ballistic test limit was obtained for impacts on an 18"×18" test cloth constructed according to Example One above. The V50 ballistic test limit is the average of 10 fair impact velocities consisting of the five lowest complete penetration velocities and five highest partial penetration velocities. The spread for the 10 velocities was not greater than an allowable range of 150 feet per second (fps). The V50 ballistic limit was determined by averaging the V50 test results for three test cloths.

A soft body-armor product is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A ballistic panel for being incorporated into a lightweight soft body-armor product adapted for covering an area of the body, said ballistic panel comprising an assembly of woven fabric plies with warp and fill yarns comprising bundled Poly (p-phenylene-2, 6-benzobisoxazole) fibers, said fibers being stretched at a draw ratio higher than 1:1 to promote dissipation of moisture, and said plies having a collective areal density of no greater than 1.0 pounds per square foot, and a V50 ballistic limit of no less than 1925 feet per second using a .22 caliber, 17 grain FSP at 0 degrees obliquity.

2. A ballistic panel according to claim 1, wherein said warp yarns weigh approximately 500 denier.

3. A ballistic panel according to claim 1, wherein said fill yarns weigh approximately 500 denier.

4. A ballistic panel according to claim 1, wherein each of said woven fabric plies comprises between 25 and 45 ends of warp yarn per inch.

5. A ballistic panel according to claim 1, wherein each of said woven fabric plies comprises between 25 and 45 ends of fill yarn per inch.

6. A ballistic panel according to claim 1, wherein said woven fabric plies are formed using a plain weave.

7. A ballistic panel according to claim 1, wherein said assembly comprises between 25 and 40 overlapping fabric plies.

8. A ballistic panel according to claim 1, wherein the tensile modulus of the warp and fill yarns is greater than 1500 grams/denier.

9. A ballistic panel according to claim 1, wherein the tensile strength of the warp and fill yarns is greater than 40 grams/denier.

10. A ballistic panel for being incorporated into a lightweight soft body-armor product adapted for covering an area of the body, said ballistic panel comprising an assembly of overlapping plain-weave fabric plies with warp and fill yarns comprising bundled Poly (p-phenylene- 2, 6-benzobisoxazole) fibers, said fibers being stretched at a draw ratio higher than 1:1 to promote dissipation of moisture, and said warp and fill yarns each weighing approximately 500 denier, and said plies having a collective areal density of no greater than 1.0 pounds per square foot, and a V50 ballistic limit of no less than 1925 feet per second using a .22 caliber, 17 grain FSP at 0 degrees obliquity.

11. A lightweight soft body-armor product adapted for covering an area of the body, said body-armor product comprising at least one ballistic panel including of an assembly of woven fabric plies with warp and fill yarns comprising bundled Poly (p-phenylene-2, 6-benzobisoxazole) fibers, said fibers being stretched at a draw ratio higher than 1:1 to promote dissipation of moisture, and said plies having a collective areal density of no greater than 1.0 pounds per square foot, and a V50 ballistic limit of no less than 1925 feet per second using a .22 caliber, 17 grain FSP at 0 degrees obliquity.

12. A body-armor product according to claim 11, wherein said body-armor product comprises a ballistic flak vest.

13. A body-armor product according to claim 11, overall weight of ballistic flak vest is less than 7.0 pounds.

14. A body-armor product according to claim 11, wherein said warp yarns weigh approximately 500 denier.

15. A body-armor product according to claim 11, wherein said fill yarns weigh approximately 500 denier.

16. A body-armor product according to claim 11, wherein each of said woven fabric plies comprises between 25 and 45 ends of warp yarn per inch.

17. A body-armor product according to claim 11, wherein each of said woven fabric plies comprises between 25 and 45 ends of fill yarn per inch.

18. A body-armor product according to claim 11, wherein said fabric plies are formed using a plain weave.

19. A body-armor product according to claim 11, wherein said ballistic panel comprises between 25 and 40 overlapping fabric plies.

20. A body-armor product according to claim 11, wherein the tensile modulus of the warp and fill yarns is greater than 1500 grams/denier.

* * * * *